US009074567B2

(12) United States Patent
Park et al.

(10) Patent No.: US 9,074,567 B2
(45) Date of Patent: Jul. 7, 2015

(54) FUEL INJECTION PUMP HAVING A SEPARABLE PLUNGER

(75) Inventors: Deuk-Jin Park, Ulsan (KR); Ju-Tae Kim, Ulsan (KR); Eung-Sung Kim, Ulsan (KR); Kang-Yun Jung, Ulsan (KR); Kwang-Cheol Heo, Ulsan (KR); Jong-Suk Kim, Ulsan (KR); Eun Ha, Ulsan (KR); Beom-Yong No, Ulsan (KR)

(73) Assignee: HYUNDAI HEAVY INDUSTRIES, CO., LTD., Ulsan (KR)

( * ) Notice: Subject to any disclaimer, the term of this patent is extended or adjusted under 35 U.S.C. 154(b) by 289 days.

(21) Appl. No.: 13/702,096

(22) PCT Filed: Oct. 27, 2010

(86) PCT No.: PCT/KR2010/007412
§ 371 (c)(1),
(2), (4) Date: Dec. 5, 2012

(87) PCT Pub. No.: WO2011/155671
PCT Pub. Date: Dec. 15, 2011

(65) Prior Publication Data

US 2013/0074811 A1 Mar. 28, 2013

(30) Foreign Application Priority Data

Jun. 9, 2010 (KR) ..... 10-2010-0054494

(51) Int. Cl.

| | |
|---|---|
| ***F04B 7/06*** | (2006.01) |
| ***F02M 59/26*** | (2006.01) |
| ***F02M 59/28*** | (2006.01) |
| ***F02M 59/44*** | (2006.01) |

(52) U.S. Cl.
CPC ..... *F02M 59/26* (2013.01); *F02M 59/28* (2013.01); *F02M 59/44* (2013.01)

(58) Field of Classification Search
CPC ..... F02M 59/265; F02B 3/06
USPC ..... 123/500–504; 417/486, 492, 499, 500
See application file for complete search history.

(56) References Cited

U.S. PATENT DOCUMENTS 2,185,144 A * 12/1939 Edwards ..... 417/494
2,455,571 A * 12/1948 Edwards ..... 417/265

(Continued)

FOREIGN PATENT DOCUMENTS

EP 0 117 219 A2 8/1984
JP 07-077131 A 3/1995

(Continued)

*Primary Examiner* — Hung Q Nguyen
*Assistant Examiner* — Josh Campbell
(74) *Attorney, Agent, or Firm* — Rabin & Berdo P.C.

(57) ABSTRACT

A fuel injection pump having a separable plunger includes a separable plunger of which outer circumference is slide coupled to an inside of the a such that a lower portion thereof is supported by an upper portion of a main plunger to enable upward and downward slide movement in association with the main plunger, wherein an injection timing control spiral step of which upper surface is formed in a spiral shape, is protrudingly formed on the outer circumference thereof and a fuel passage is formed on one side of the outer circumference thereof including the injection timing control spiral step and an elastic member having a lower portion elastically supported by the separable plunger and an upper portion inserted within the barrel to be supported by an upper surface of the barrel.

3 Claims, 6 Drawing Sheets

(56) References Cited

U.S. PATENT DOCUMENTS

| | | | | | |
|---|---|---|---|---|---|
| 4,524,737 | A | * | 6/1985 | Hofman | 123/300 |
| 4,712,985 | A | * | 12/1987 | Wakasa et al. | 417/486 |
| 4,861,243 | A | * | 8/1989 | Wade | 417/499 |
| 4,897,024 | A | * | 1/1990 | Hatz et al. | 417/499 |
| 5,020,979 | A | | 6/1991 | Askew | |
| 5,482,016 | A | | 1/1996 | Ohishi et al. | |
| 5,566,660 | A | * | 10/1996 | Camplin et al. | 123/496 |
| 5,592,915 | A | | 1/1997 | Ishiwata et al. | |
| 6,273,069 | B1 | * | 8/2001 | Nestvall | 123/502 |

FOREIGN PATENT DOCUMENTS

| | | | |
|---|---|---|---|
| JP | 07-054617 | Y2 | 12/1995 |
| KR | 20-1999-0031662 | U | 7/1999 |

* cited by examiner

FUEL INJECTION PUMP HAVING A SEPARABLE PLUNGER

TECHNICAL FIELD

The present invention relates to a fuel injection pump having a separable plunger and, more particularly, to a fuel injection valve having a separable plunger, being capable of not only easily adjusting a timing and a form of fuel injection with a simple structure but also enabling fine pre-injection of an engine at high pressure, thereby assisting in warming up within an engine cylinder, such that complete combustion may occur when main fuel is entered.

BACKGROUND ART

Hereinafter, a background art and a problem thereof will be described with reference to drawings.

FIG. 1 is an internal cross sectional view for explaining a conventional fuel injection pump, and referring to FIG. 2, a general conventional fuel injection pump includes a pump casing 10, a barrel 11, and a plunger 12.

The pump casing 10 of the conventional fuel injection pump configured as above has a barrel insertion groove 100 formed thereinside and a fuel input hole 102 connected to a fuel inlet penetrates through a center portion of an outer circumference thereof so as to be connected to the barrel insertion groove 100.

The barrel 11 is mounted to the barrel insertion groove 100 of the pump casing 10, and a fuel relief plug 110 is installed on a center portion of an outer circumference thereof so as to connect the fuel inlet hole 102 and a plunger coupling hole 111 formed inside.

The plunger 12 is slidably coupled to the plunger coupling hole 111 of the barrel 11 so that a lower portion thereof is protruded outwardly from the barrel 11 and a lower portion of the pump casing 10.

The general fuel injection pump of a diesel engine configured as above injects fuel by the plunger 12 respectively installed on each cylinder. Thus, fuel injection may have a combustion pattern corresponding to one cycle by a cam, and only a volume is determined in the plunger 12, and it is not possible to control the value of the volume during an operation in order for fine injection and incomplete combustion prior to combustion, thereby requiring an additional variable fuel injection timing adjustment apparatus in order to change a fuel injection timing during the operation. In other words, in case of a mechanic type apparatus, the injection timing is adjusted by moving the barrel 11 inserted thereinside upward and downward, and, in case of an electronic type, a crank angle is read in a form of a common rail to perform the fuel injection at a required timing.

However, a variable fuel injection timing apparatus as above is very expensive, and adjustment or control thereof is very difficult. In addition, only a volume of fuel can be controlled by forming a spiral groove (helices) on the plunger 12 such that a main volume of engine injection fuel is injected in only a predetermined pattern.

Also, in the conventional fuel injection pump as above, because one cycle is formed by only one plunger 12 in the pump, any different combustion pattern cannot be implemented without an additional apparatus. Also, because a fuel amount and the injection timing should be adjusted by one plunger 12, it is difficult to form various fuel injection patterns. Such pattern has a problem in that an engine operation as well as a fuel change and a timing thereof need to be adjusted very carefully during an operation, and it is difficult for every load area to show an optimal performance because all areas of an engine load are coped with one plunger 12 within one fuel injection pump, and a load is not actively coped with, thereby causing a problem of fuel efficiency and a problem of harmful gas discharge.

DISCLOSURE

Technical Problem

Therefore, an objective of the present invention is to provide a fuel injection pump having a separable plunger, in which two plungers are installed in one fuel injection pump such that two plungers may have different combustion patterns in one cycle according to a fuel cam, thereby achieving improved engine performance through diversification of a fuel injection pattern.

Another objective of the present invention is to adjust a fuel injection amount by individually operating each plunger within the fuel injection pump according to an engine load.

Another objective of the present invention is to provide a warming-up injection and pre-injection for complete combustion within one cycle, thereby being capable of removing a contaminated material within a combustion chamber, reducing discharged harmful gas, and adjusting a fuel injection timing according to an engine combustion pattern at a timing of an initial preliminary injection.

Technical Solution

The present invention for achieving the above-mentioned objective provides a fuel injection pump having a separable plunger, wherein a barrel is installed within a main pump casing, a main plunger of which lower portion is protruded in a downward direction of the barrel is slidably coupled to an inside of the barrel, and a main fuel outlet is formed through the main pump casing and the barrel to be connected to each other, so that the main plunger is slidingly moved upward and downward along the barrel to compress fuel introduced within the barrel through a main fuel input hole and a main fuel relief plug to be provided to a fuel injection hole through the main fuel outlet, the fuel injection pump including: the separable plunger of which outer circumference is slidably coupled to an inside of the barrel such that a lower portion thereof is supported by an upper portion of the main plunger to enable upward and downward slide movement in association with the main plunger, wherein an injection timing adjustment step of which upper surface is formed in a spiral shape is protrudingly formed on the outer circumference thereof, and a fuel passage is formed on one side of the outer circumference thereof including the injection timing control spiral step, and an elastic member having a lower portion elastically supported by the separable plunger and an upper portion inserted within the barrel to be supported by an upper surface of the barrel.

The fuel injection pump may further include a preliminary fuel injection adjustment means installed on an upper portion of the main pump casing and having a lower portion thereof inserted within the main pump casing and the barrel to be inserted within the separable plunger and coupled thereto, thereby rotating the separable plunger adjust a timing of fuel injection.

Here, the preliminary fuel injection adjustment means may include a rotation axis of which lower portion is inserted within the main pump casing and the barrel to be inserted and coupled to an inside of the separable plunger; a timing adjustment rack installed on an upper portion of the rotation axis to be located outside of the main pump casing; a timing pinion gear connected to the timing control rack; and a stop nut screw coupled to an upper end portion of the rotation axis.

Also, the separable plunger may further include a preliminary injection spiral protrusion protrudingly formed on an outer circumference thereof and separated from the injection timing adjustment step at a predetermined interval such that a preliminary injection fuel passage is formed between the preliminary injection spiral protrusion and an upper surface of the injection timing adjustment step.

As described above, the fuel injection valve having the separable plunger according to the present invention is provided with, in addition to the main plunger, the separable plunger, which is slidingly moved upward and downward in association with the main plunger such that fuel may be preliminarily injected through the separable plunger before the fuel is compressed and injected as a main injection by the main plunger, thereby enabling injection warming up and, at the same time, injecting as a post injection the remaining fuel after the main injection through the separable plunger, so that combustion performance may be improved, fuel consumption ratio may be decreased, and exhaust gas may be reduced, thereby improving an overall engine performance.

Also, in the fuel injection valve having the separable plunger according to the present invention, the rotation axis of the preliminary fuel injection adjustment means is moved upward and downward to easily adjust the fuel injection timing from an exterior as well as the preliminary fuel injection adjustment means is installed on the upper portion of the main pump casing, thereby achieving an effect that an operation for adjusting the fuel injection timing is very convenient and a very easy repair is rendered.

Further, the fuel injection valve having the separable plunger according to the present invention is provided with the separable plunger on which the injection timing adjustment step of which upper portion is formed in a spiral shape is formed such that a vertical height of the separable plunger may be adjusted by using the preliminary fuel injection adjustment means, thereby adjusting various time points of fuel injection timing.

Figure 1:
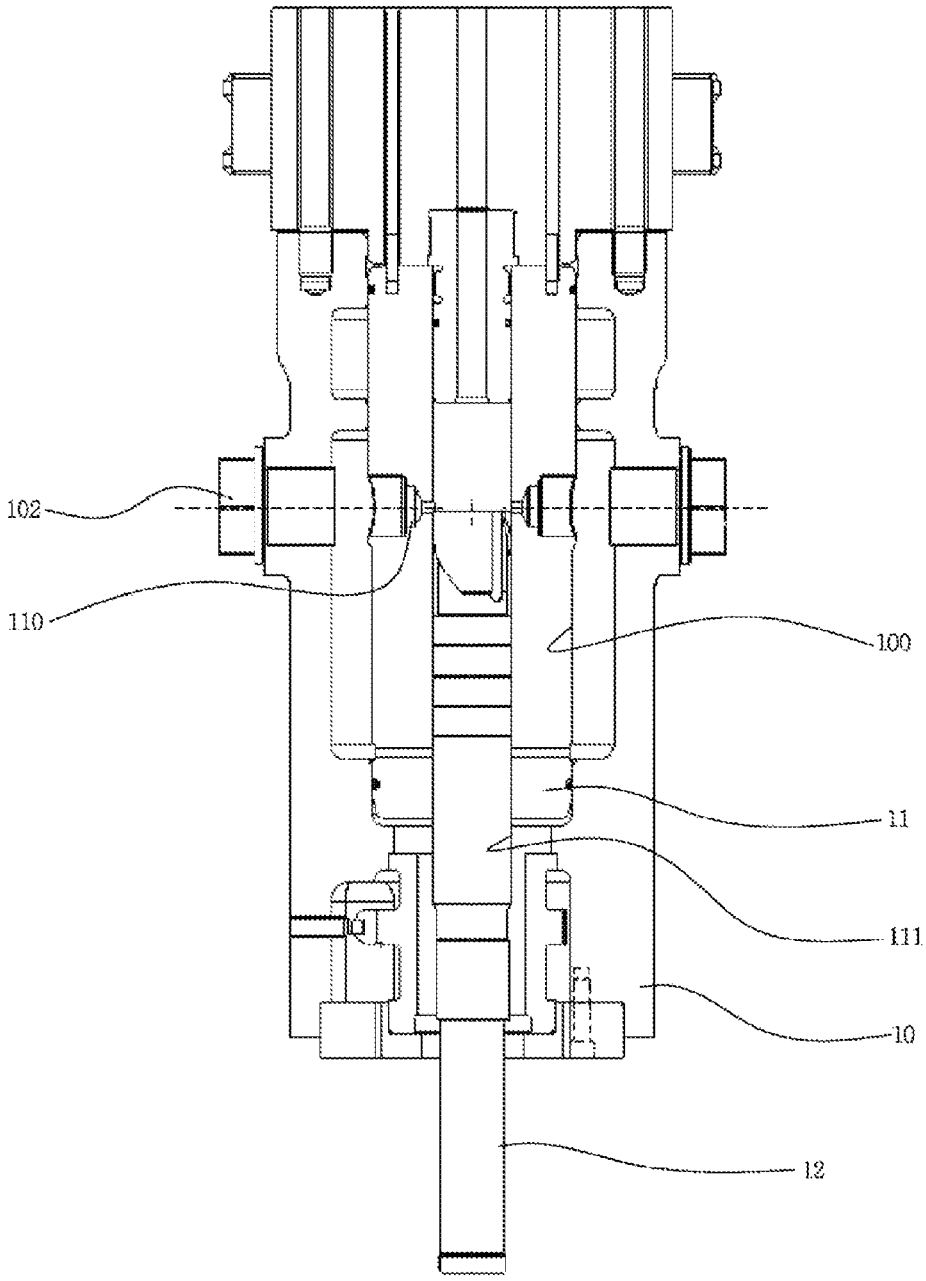
FIG. 1 (PRIOR ART)
FIG. 1 is an internal cross sectional view for explaining a conventional fuel injection pump.

DESCRIPTION OF SYMBOLS (10): main pump casing
(11): barrel
(12): main plunger
(13): separable plunger
(14): elastic member
(15): preliminary fuel injection adjustment means
(16): main pump fuel adjustment means

MODE FOR INVENTION

Hereinafter, exemplary embodiments of the present invention will be described with reference to the accompanying drawings. For illustrative purposes, it should be noted that like numbers refer to like elements of a conventional fuel injection pump.

Figure 2:
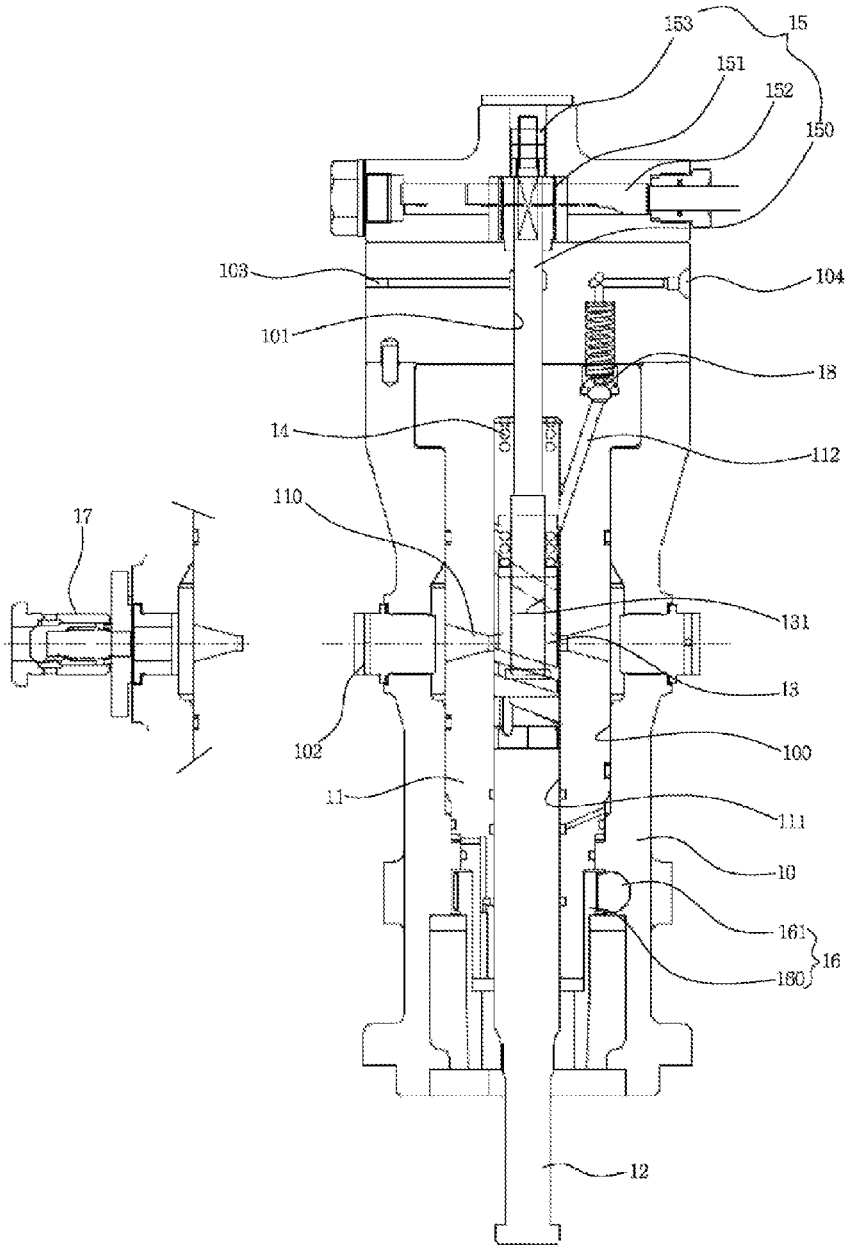
FIG. 2 is a cross sectional view illustrating a fuel injection pump having a separable plunger according to an exemplary embodiment of the present invention.
Figure 3:
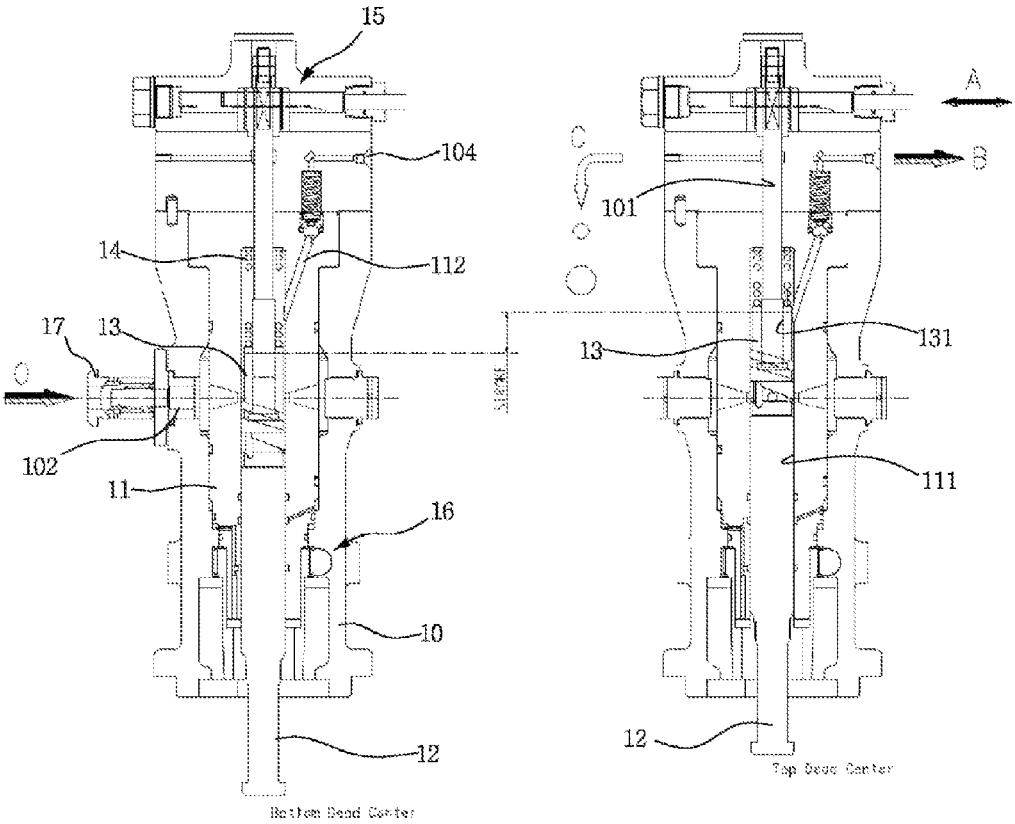
FIG. 3 is a view for explaining an operational process of a fuel injection pump having a separable plunger according to the present invention.
Figure 4:
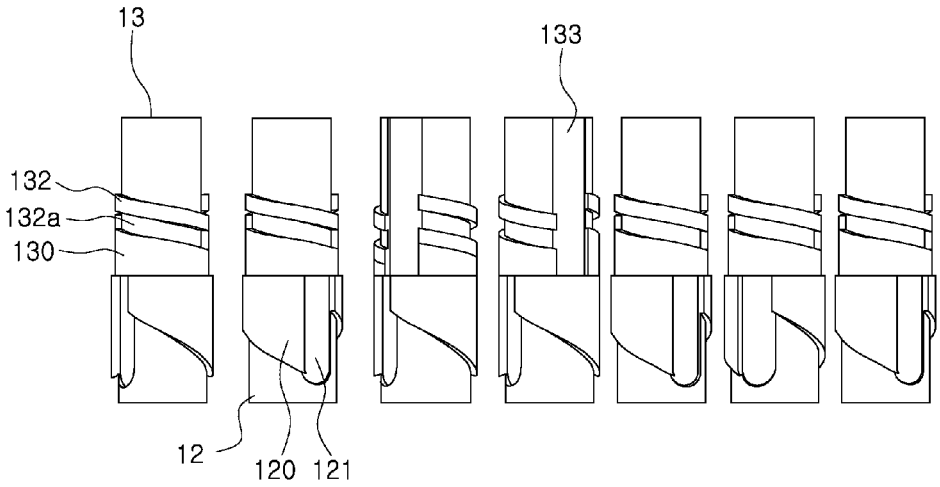
FIG. 4 is a view illustrating a combination of an injection section form of a main plunger and a separable plunger corresponding to various cases according to the present invention.
Figure 5:
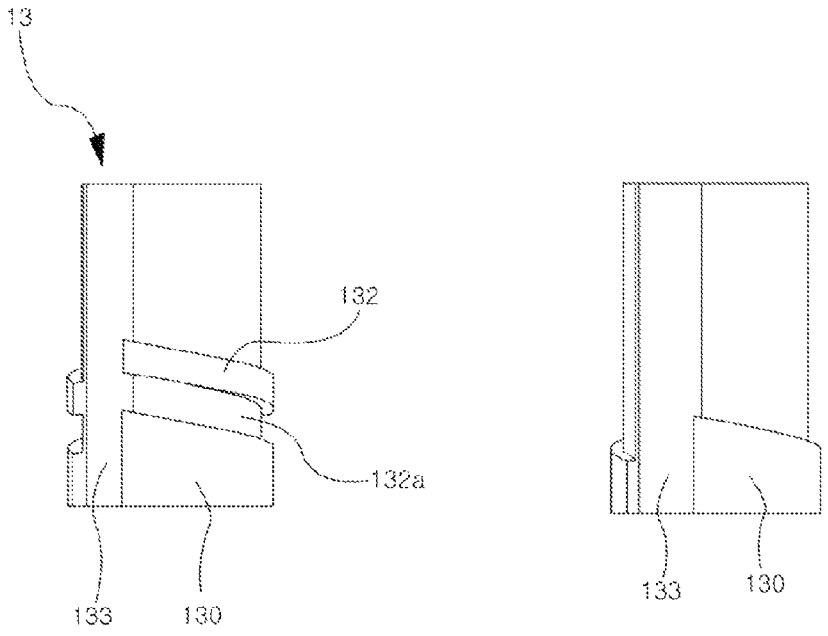
FIG. 5 is a view for explaining a separable plunger according to the present invention.

FIG. 2 is a cross sectional view illustrating a fuel injection pump having a separable plunger according to an exemplary embodiment of the present invention, FIG. 3 is a view for explaining an operational process of a fuel injection pump having a separable plunger according to the present invention, FIG. 4 is a view illustrating a combination of an injection section form of a main plunger and a separable plunger corresponding to various cases according to the present invention, and FIG. 5 is a view for explaining a separable plunger according to the present invention.

Referring to FIGS. 2 through 5, a fuel injection pump having a separable plunger is configured to include a main pump casing 10, a barrel 11, a main plunger 12, a separable plunger 13, an elastic member 14, a preliminary fuel injection adjustment means 15, and a main pump fuel adjustment means 16.

The main pump casing 10 of the fuel injection pump having the separable plunger according to an exemplary embodiment of the present invention includes a barrel insertion groove 100 formed thereinside, a rotation axis insertion groove 101 formed in a direction of a barrel insertion groove 100 on an upper surface so as to be connected to an upper portion of the barrel insertion groove 100, a main fuel input hole 102 disposed in a center portion of an outer circumference thereof so that a fuel inhale hole 17 is connected to the barrel insertion groove 100, a drain line 103 penetrating one side of an upper portion of the outer circumference and connected to the barrel insertion groove 100, and a first part of a main fuel outlet 104 formed on the other side of the upper portion of the outer circumference.

The barrel 11 is inserted and mounted to the barrel insertion groove 100 of the main pump casing 10 and has a main fuel relief plug 110 installed on a center portion of an outer circumference to accept an end of the fuel inhale hole 17 and to connect the main fuel input hole 102 and the plunger coupling hole 111. The barrel 11 also has a plunger coupling hole 111 formed inside, and has a second part of the main fuel outlet 112 of which lower portion is connected to the plunger coupling hole 111 and of which upper portion is connected to a lower portion of the first part of the main fuel outlet 104 formed on the main pump casing 10.

The main plunger 12 is slidably coupled to the plunger coupling hole 111 of the barrel 11 such that a lower portion thereof protrudes outwardly from a lower portion of the barrel 11 and the main pump casing 10. Also, the main plunger 12 has an injection timing control spiral step 120 of which lower portion is formed in a spiral shape is formed in an upper portion of the main plunger 12 and a fuel passage 121 which is formed on one side of an outer circumference including the injection timing control spiral step 120.

The separable plunger 13 is slidably coupled to the plunger coupling hole 111 formed within the barrel 11 such that a lower portion thereof is supported by an upper portion of the main plunger 12 so as to slidingly move upward and downward in association with the main plunger 12, an injection timing adjustment step 130 of which upper surface is formed in a spiral shape is protrudingly formed on an outer circumference of the separable plunger 13, a fuel passage 133 is formed on one side of an outer circumference including the injection timing adjustment step 130, and a rotation axis insertion hole 131 is formed in a direction from an upper surface to a lower surface. Also, in the separable plunger 13, a preliminary injection spiral protrusion 132 may be further formed on an outer circumference thereof and separated from the injection timing adjustment step 130 at a predetermined interval such that a preliminary injection fuel passage 132*a* is formed between the preliminary injection spiral protrusion 132 and an upper surface of the injection timing adjustment step 130.

The elastic member 14 has a lower portion elastically supported by the separable plunger 13 and an upper portion inserted to the plunger coupling hole 111 so as to be supported by an upper surface of the plunger coupling hole 111 formed within the barrel 11.

The fuel injection pump further comprises the preliminary fuel injection adjustment means 15 which is installed on an upper portion of the main pump casing 10, and a lower portion thereof is inserted within the main pump casing 10 and the barrel 11 to be inserted within the separable plunger 13 and slidably coupled thereto, thereby rotating the separable plunger 13 to adjust a timing of fuel injection.

A configuration of the preliminary fuel injection adjust means 15 will be described in detail; the preliminary fuel injection adjustment means 15 includes a rotation axis 150, a timing adjustment rack 151, a timing pinion 152, and a stop nut 153.

The rotation axis 150 of the preliminary fuel injection adjustment control means 15 has a lower portion which is inserted within the main pump casing 10 and the barrel 11 to be slidably coupled to an inside of the separable plunger 13, i.e., a rotation axis insertion hole 101 formed in a direction from an upper surface to a lower surface of the separable plunger 13. Also, the timing control rack 151 is installed on an upper portion of the rotation axis 150 to be located outside of the main pump casing 10. Also, the timing pinion 152 is engaged with the timing control rack 151. The stop nut 153 is engaged to an upper end portion of the rotation axis 150.

The main pump fuel adjustment means 16 comprises a main pump fuel adjustment pinion 160 installed on a lower portion of an outer circumference of the barrel 11 and a main pump fuel adjustment rack 161 engaged with the main pump fuel adjustment pinion 160.

Also, the fuel adjustment valve having the separable plunger may further comprise a return prevention valve 18 installed in the main fuel outlet 104, 112 formed on the main pump casing 10 and the barrel 11.

Referring now to FIGS. 2 through 6, an operational effect of the fuel injection pump having the separable plunger according to an exemplary embodiment of the present invention is described below.

Figure 6:
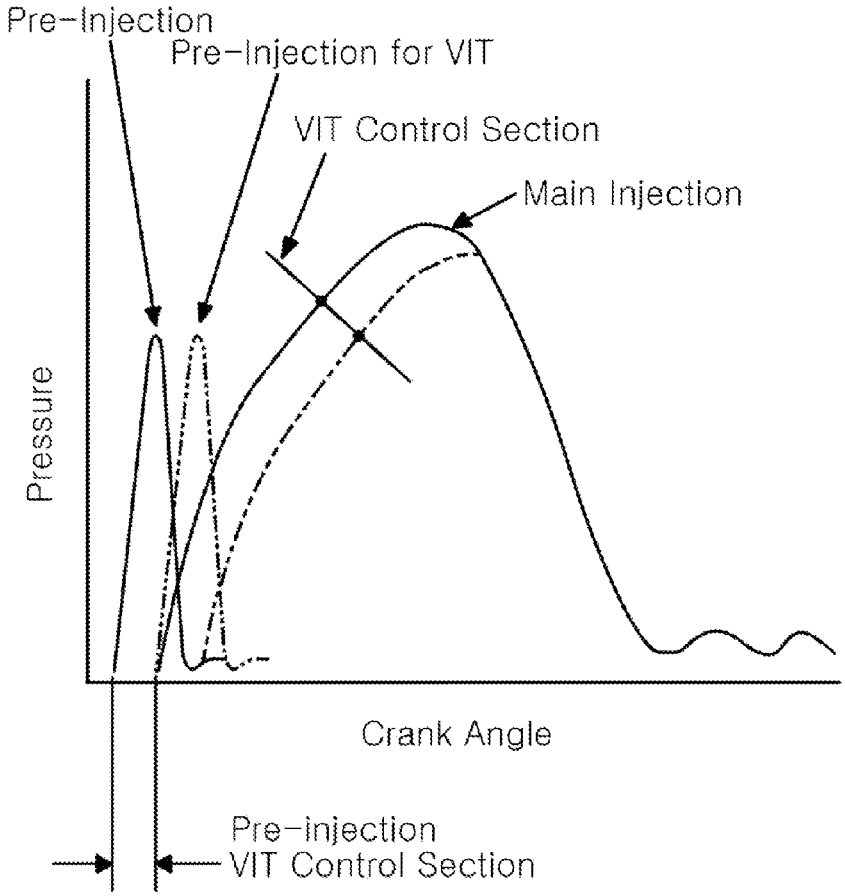
FIG. 6 is an example view illustrating a form of a pre-injection according to a fuel injection form of a separable plunger according to the present invention.

FIG. 6 is an example view illustrating a form of a pre-injection according to a fuel injection form of a separable plunger according to the present invention.

Referring to FIGS. 2 through 6, in the fuel adjustment pump having the separable plunger according to the present invention, fuel is introduced to an inside of the barrel 11, i.e., an inside of the plunger coupling hole 111 of the barrel 11, sequentially through the main fuel input hole 102 and the main fuel relief plug 110 and be in a standby state.

As above, the fuel introduced to the inside of the plunger coupling hole 111 of the barrel 11 and be in the standby state is compressed at high pressure by the main plunger 12 and the separable plunger 13 which are slidingly moved and elevated by a cam axis (not shown) which is driven by an engine.

In other words, the main plunger 12 is slidingly moved and elevated along the plunger coupling hole 111 by the cam axis (not shown) which is driven by the engine, and when the main plunger 12 is elevated as above, by the main plunger 12, the separable plunger 13 is also slidingly elevated along the rotation axis 150 and the plunger coupling hole 111 by the main plunger 12. Here, the elastic member 14 which elastically supports the separable plunger 13 is in a compressed state by the separable plunger 13, and as the main plunger 12 and the separable plunger 13 are slidingly moved and elevated, the fuel introduced to the inside of the plunger coupling hole 111 of the barrel 11 sequentially through the fuel inhale hole 17, the main fuel input hole 102 and the main fuel relief plug 110 is compressed at the high pressure.

Here, the main plunger 12 and the separable plunger 13 are further elevated along the plunger coupling hole 111 and the rotation axis 150 such that the preliminary injection fuel passage 132*a* of the separable plunger 13 is positioned on the same plane with the main fuel relief plug 110, and the fuel introduced to the inside of the plunger coupling hole 11 and compressed at the high pressure is preliminarily injected to an inside of a combustion chamber sequentially through the preliminary injection fuel passage 132*a*, the fuel passage 133 of the separable plunger 13, and the main fuel outlet 112, 104.

Meanwhile, when the timing pinion 152 of the preliminary fuel injection adjustment means 15 is rotated, the rotation axis 150 is elevated or lowered by the timing adjustment rack 151 such that a timing point at which the preliminary injection fuel passage 132 is opened is adjusted, thereby adjusting a preliminary injection timing of the fuel.

When the main plunger 12 and the separable plunger 13 are further elevated after the compressed fuel is preliminary injected, the main fuel relief plug 110 is blocked by the injection timing adjustment step 130 of the separable plunger 13 and the injection timing control spiral step 120 of the main plunger 12 such that the fuel is gradually compressed to high pressure as the separable plunger 13 and the main plunger 12 are elevated.

As above, as the separable plunger 13 and the main plunger 12 are elevated, the fuel is gradually compressed to the high pressure and, when the injection timing control spiral step 120 of the main plunger 12 is located at an upper portion of the main fuel relief plug 110, fuel within the plunger coupling hole 11 is injected to the inside of the combustion chamber as the main injection sequentially through the fuel passage 121 and the main fuel outlet 112, 104.

After the main injection of the fuel is completed, the separable plunger 13 and the main plunger 12 are lowered by an elastic force of the elastic member 14 compressed by the separable plunger 13, and as the separable plunger 13 and the main plunger 12 are lowered, remaining fuel is injected to the inside of the combustion chamber as the post injection sequentially through the preliminary injection fuel passage 132*a*, the fuel passage 133 of the separable plunger 13 and the main fuel outlet 112, 104 from a time point at which the preliminary injection fuel passage 132*a* of the separable plunger 13 is located below the main fuel relief plug 110.

As described above, the fuel injection valve having the separable plunger according to the present invention is provided with, in addition to the main plunger 12, the separable plunger 13 which is slidingly moved upward and downward in association with the main plunger 12. Thus, the fuel can be preliminarily injected through the separable plunger 13 before the fuel is compressed and injected by the main plunger 12, thereby enabling warming-up injection. Also, because after the main injection, the remaining fuel can be post-injected through the separable plunger 13, combustion performance may be improved, fuel consumption ratio may be decreased, and exhaust gas may be reduced, thereby improving an overall engine performance.

Also, in the fuel injection valve having the separable plunger according to the present invention, the rotation axis 150 of the preliminary fuel injection adjustment means 15 is moved upward and downward to easily adjust the fuel injection timing from an exterior, and the preliminary fuel injection adjustment means 15 is installed on the upper portion of the main pump casing, thereby being advantageous in that an operation for adjusting the fuel injection timing is very convenient and a very easy repair is rendered.

Further, the fuel injection valve having the separable plunger according to the present invention is provided with the separable plunger 13 on which the injection timing adjustment step 130 of which upper portion is formed in a spiral shape is formed such that a vertical height of the separable plunger 13 may be adjusted by using the preliminary fuel injection adjustment means 15, thereby adjusting various time points of fuel injection timing.

The present invention is not limited to particular preferable exemplary embodiments described above and it will be understood by those of ordinary skill in the art that various modifications may be made without departing from the spirit and scope of the present invention as defined by the following claims.

What is claimed is:

1. A fuel injection pump comprising:

a pump casing;

a barrel installed in the pump casing and having a plunger coupling hole thereinside;

a fuel outlet of which a first part is formed in the pump casing and a second part is formed in the barrel, the fuel outlet connecting the plunger coupling hole to an outside of the pump casing;

a fuel relief plug disposed on a center portion of a lateral side of the barrel separately from the fuel outlet and having a first end open to the plunger coupling hole from the lateral side;

a fuel input hole disposed on a center portion of the pump casing and having a first end facing a second end of the fuel relief plug and a second end open to an outside of the pump casing;

a main plunger slidably installed in the plunger coupling hole and including an injection timing control spiral step protrudingly formed on a first end portion of the main plunger and having a spiral shape in a side thereof to adjust a main-injection timing, and a first fuel passage formed on one side of an outer circumference of the main plunger and allowing a fuel to flow from the plunger coupling hole to the fuel outlet, wherein a second end portion of the main plunger being exposed out of the barrel;

a separable plunger slidably installed in the plunger coupling hole and having a first end portion adjoining the first end portion of the main plunger, thereby sliding upward and downward in association with the main plunger, the separable plunger including an injection timing adjustment step disposed in the first end portion of the separable plunger and protrudingly formed on an outer circumference of the separable plunger, the injection timing adjustment step having a spiral shape in a side thereof to adjust a pre-injection timing, a preliminary injection spiral protrusion protrudingly formed on the outer circumference of the separable plunger in the spiral shape and separated from the injection timing adjustment step at a predetermined interval, a preliminary injection fuel passage formed between the injection timing adjustment step and the preliminary injection spiral protrusion, both sides of the preliminary injection fuel passage having the spiral shape, and a second fuel passage formed on a surface of the separable plunger in a longitudinal direction; and an elastic member disposed in the plunger coupling hole and having a first end supported by the separable plunger and a second end supported by an upper surface of the plunger coupling hole.

2. The fuel injection pump of claim 1, further comprising:

a preliminary fuel injection adjustment means disposed on an upper portion of the main pump casing and coupled to a second end portion of the separable plunger, thereby rotating the separable plunger to adjust a timing of fuel injection.

3. The fuel injection pump of claim 2, wherein the preliminary fuel injection adjustment means comprises:

a rotation axis coupled to the separable plunger;

a timing adjustment rack installed on an upper portion of the rotation axis to be located outside of the main pump casing;

a timing pinion gear connected to the timing control rack; and a stop nut screw coupled to an upper end portion of the rotation axis.

* * * * *